United States Patent [19]

Schwarzkopf

[11] 4,339,121

[45] Jul. 13, 1982

[54] ORBITAL AMUSEMENT-PARK RIDE

[75] Inventor: Anton Schwarzkopf, Münsterhausen, Fed. Rep. of Germany

[73] Assignee: Firma Anton Schwarzkopf Fahrzeug- und Stahlbau, Münsterhausen, Fed. Rep. of Germany

[21] Appl. No.: 240,218

[22] Filed: Mar. 3, 1981

[30] Foreign Application Priority Data

Nov. 13, 1980 [DE] Fed. Rep. of Germany ..... 3042872

[51] Int. Cl.[3] ..... A63G 1/08

[52] U.S. Cl. ..... 272/38; 272/49

[58] Field of Search ..... 272/28 R, 29, 38, 49, 272/50, 85, 86, 87, 88, 89, 90, 91, 92

[56] References Cited

U.S. PATENT DOCUMENTS

| | | | |
|---|---|---|---|
| 1,510,355 | 9/1924 | Tymkow | 272/38 UX |
| 1,527,812 | 2/1925 | Meckl | 272/28 R |
| 1,935,558 | 11/1933 | Haskell | 272/49 X |
| 2,076,113 | 4/1937 | Bartlett | 272/38 X |
| 2,800,328 | 7/1957 | Courtney | 272/38 |
| 3,405,938 | 10/1968 | Aydelott | 272/38 X |

FOREIGN PATENT DOCUMENTS

| | | | |
|---|---|---|---|
| 317074 | 4/1934 | Italy | 272/49 |
| 412746 | 7/1934 | United Kingdom | 272/85 |

*Primary Examiner*—Richard J. Apley
*Assistant Examiner*—Arnold W. Kramer
*Attorney, Agent, or Firm*—Karl F. Ross

[57] ABSTRACT

An orbital amusement ride adapted to stand on the ground has a pair of spaced-apart posts standing on the ground and having respective upper ends defining respective pivot axes that are generally parallel and define a generally horizontal plane with the posts generally perpendicular to this plane and spaced apart thereon parallel to the axes. Respective generally parallel arms are pivotal on the posts about the respective axes and have respective diametrically opposite first and second arm ends. A drive in one of the posts rotates the arms jointly and synchronously about the respective axes with the first arm ends spaced horizontally from each other and the second arm ends spaced horizontally from each other also. A first passenger-receiving car is pivoted on and bridges the first arm ends and a second passenger-receiving car is pivoted on and bridges the second arm ends. Thus on joint synchronous rotation of the arms each of the cars describes a generally elliptical orbit lying in a vertical plane and generally bisected by the horizontal plane of the arm axes.

11 Claims, 5 Drawing Figures

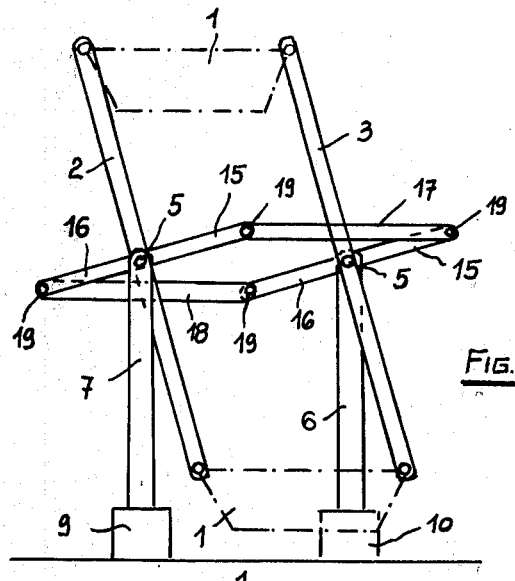
FIG. 3
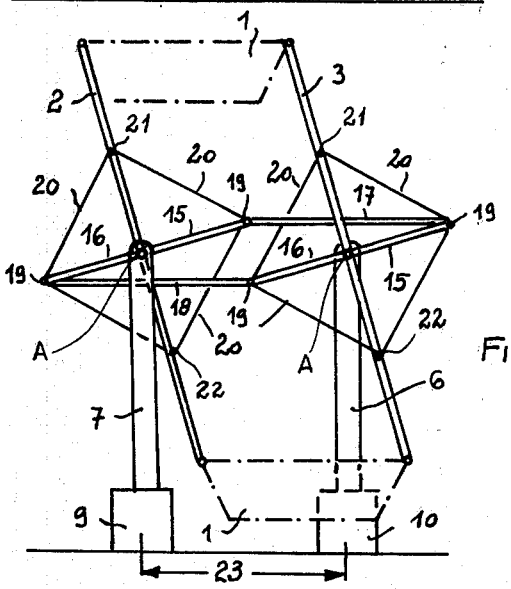
FIG. 4
FIG. 5
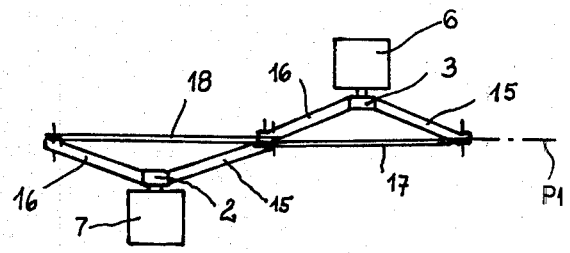

ORBITAL AMUSEMENT-PARK RIDE

FIELD OF THE INVENTION

The present invention relates to an orbital amusement-park ride. More particularly this invention concerns such a ride wherein a car filled with passengers is displaced through a generally circular or elliptical orbit lying in a vertical plane.

BACKGROUND OF THE INVENTION

An amusement-park ride is known wherein a car full of passengers is displaced through a circular or generally elliptical orbit lying in a vertical plane. Such an arrangement is shown, for example, in German utility model No. 8,007,321. This arrangement has a large upright post whose upper end defined a horizontal pivot axis. An elongated arm is pivoted at its center on the post at this axis and has at one end a passenger-receiving car and at the other end a large counterweight. Complex mechanism is provided to maintain the passenger-receiving car horozontal so that no one falls out as it follows its orbital path. Such an arrangement is relatively bulky and can normally only be dimensioned to hold a limited number of passengers. In addition a considerable amount of energy must be expended to operate the ride, relative to the small number of passengers which can be carried.

Another system is described in German utility model No. 8,011,876. In this arrangement four posts extending vertically parallel to each other and lying, as seen from above, on the corners of a horizontal rectangle, each support a respective arm of the above-described type. Thus each of these arms has at one end a counterweight and is attached at the other end to a single car carried by four pivots on the four arm ends and positioned so that it always automatically remains parallel to the ground. This system provides an extremely pleasant and exhilarating ride, nonetheless it takes up a considerable amount of ground space and itself is a great deal of heavy and complex equipment. Thus making such an orbital amusement ride portable for use in small fairs and the like is virtually impossible.

OBJECTS OF THE INVENTION

It is therefore an object of the present invention to provide an improved orbital amusement-park ride.

Another object is the provision of such a ride which takes up a relatively limited amount of ground space, and which is itself a relatively simple piece of equipment.

SUMMARY OF THE INVENTION

These objects are attained according to the instant invention in a ride having a pair of spaced-apart posts standing on the ground and having respective upper ends defining respective pivots axes that are generally parallel and define a generally horizontal plane with the posts generally perpendicular to this plane and spaced apart thereon parallel to the axes. Respective generally parallel arms are pivotal on the posts about the respective axes and have respective diametrally opposite first and second arm ends. Drive means rotate these arms jointly and synchronously about the respective axes with the first ends spaced horizontally from each other and the second ends also spaced horizontally from each other. A first passenger-receiving car is pivoted on and bridges the first arm ends and a second passenger-receiving car is pivoted on and bridges the second arm ends. Thus on joint synchronous rotation of the arms each of the cars describes a generally elliptical orbit lying in a vertical plane and generally bisected by the horizontal plane defined by the arm pivot axes.

With the system according to the instant invention it is therefore possible to support a pair of relatively large passenger-receiving cars on a pair of posts. These cars lie between the arms and each have one end supported on one arm and one end supported on the other, so that they pass over and under one another as they orbit about their elliptical paths. According to this invention the cars are constituted as rigid links between the respective arm ends so that they inherently form a parallelogrammatic linkage that maintains these cars perfectly horizontal. As a result it is not necessary to provide complex equipment to keep the cars horizontal.

As a result of only using two posts spaced diagonally apart at the corners of an imaginary square constituting the ground space occupied by the ride the construction costs are greatly reduced. At the same time the simplification of the machinery obviously reduces the possibility of breakdown and increases the service life of the machine. The posts can even be spaced apart horizontally perpendicular to the axes by a distance shorter than the radial distance between each arm end and the respective axis.

According to another feature of this invention each of the arms is provided with a transverse crosspiece which is somewhat shorter than the arm, and the crosspiece ends are interconnected together. They may be interconnected together by diagonal links or braces extending across a vertical plane equispaced between the two posts and perpendicular to the axes. Otherwise it is possible to bend the ends of these crosspieces in so that the interconnecting links lie on this vertical plane.

In accordance with another feature of this invention struts are provided interconnecting each of the crosspiece ends with the respective arm so as to rigidify the entire assembly. The struts of each arm can therefore form a square and can be constituted simply by cables.

According to yet another feature of this invention each of the cars is connected at one end via a simple pivot bearing to the respective arm end, the pivot bearing normally defining a horizontal pivot axis extending horizontally through the car. At the other end the car is connected via a pair of swivel or self-lining bearings to the other arm to compensate for torsion and minor misalignment.

It is possible to extend these crosspieces so that they are the same length as the arms and to mount another pair of cars between their ends. Thus the system can have four such cars.

The invention is based on the recognition that the arms when in the horizontal position tend to stabilize at a dead point. With the above-described bearings the dead point is quickly passed over. This is best combined with the use of the above-described crosspieces to transmit rotary force effectively from the one arm to the other.

According to this invention the drive for the system can be a simple heavy-duty electric motor and brake mounted at the base of one post and connected to a sprocket carried at the axis on the respective arm. An endless chain or belt can connect the motor to this sprocket for transmitting the rotary force.

BRIEF DESCRIPTION OF THE DRAWING

FIGS. 3 and 4 are side views of further systems according to this invention; and FIG. 5 is a top view of the system of FIG. 3.

SPECIFIC DESCRIPTION

Figure 1:
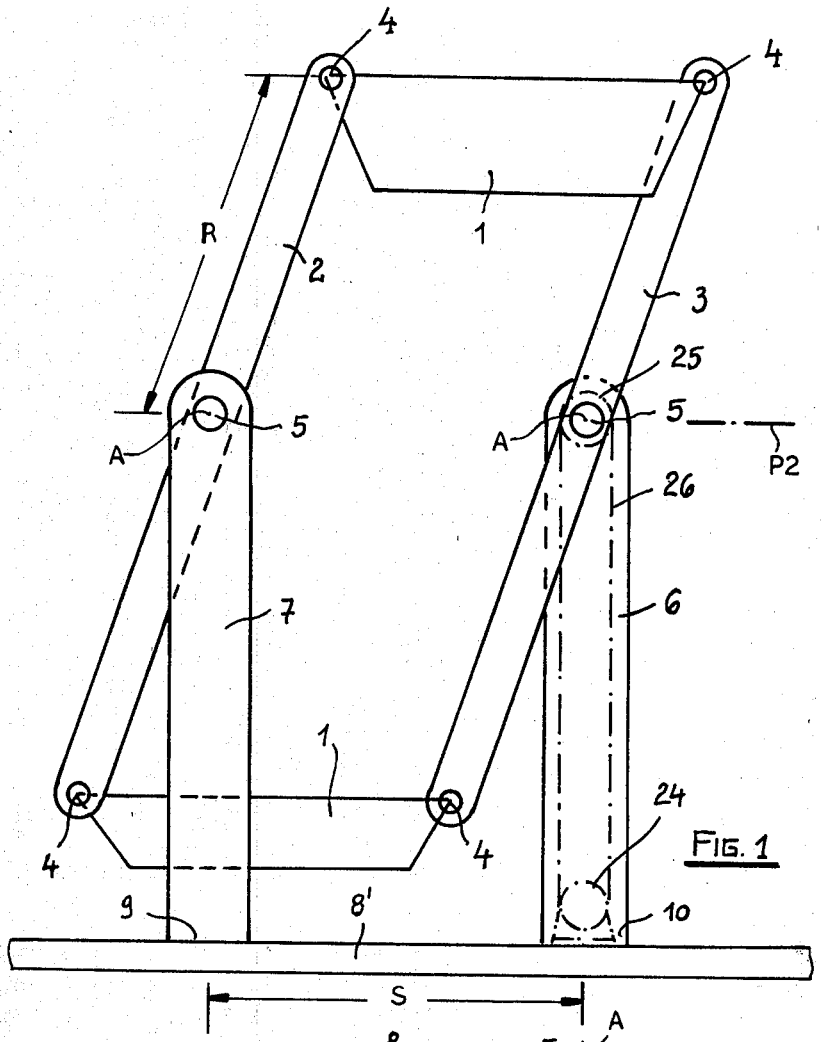
FIG. 1 is a side view of the ride according to this invention.
Figure 2:
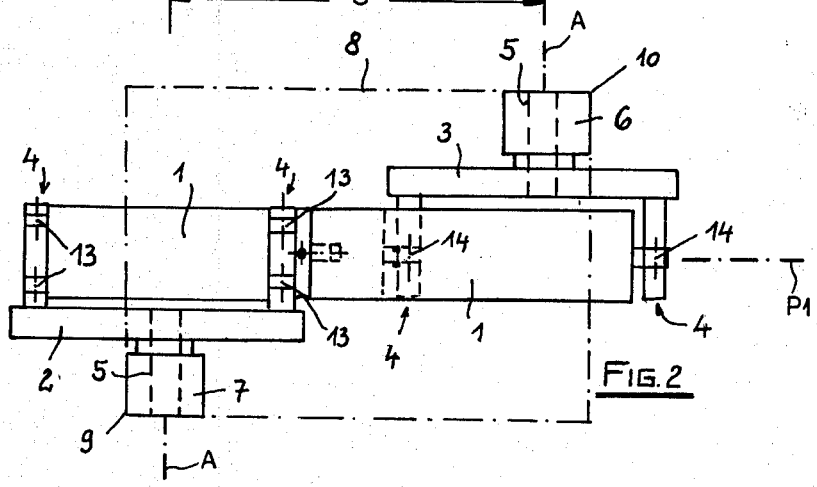
FIG. 2 is a top view of the ride of FIG. 1.

As shown in the drawing in FIGS. 1 and 2 a pair of like passenger-receiving horizontal cars 1 are carried on horizontal support shafts 4 extending parallel to one another from the outer ends of arms 2 and 3 pivoted on pivots 5 about main axes A on the upper ends of support posts 6 and 7. Each arm 2 or 3 has a radial dimension R between its shafts 4 and axis A. The posts 6 and 7 as shown in FIG. 2 lie at diagonally opposite corners of an imaginary rectangle 8 subdivided by a vertical symmetry plane P1 perpendicular to the axes A and equispaced between the posts 6 and 7. The horizontal spacing S perpendicular to the axes A is substantially less than the dimension R. Another plane P2 is defined by the parallel axes A and extends horizontally perpendicular to the vertical plane P1. The bases 9 and 10 of the posts 6 and 7 can be mounted on a portable support indicated at 8' in FIG. 1.

Each of the cars 1 is supported at one end on one of the arms 2 or 3 on a single swivel bearing 14 defining a horizontal axis and at the other end by means of a pair of self aligning bearings 13 defining respective horizontal axes parallel to the axis of the bearing 14. Thus minor maladjustment between the two posts 6 and 7 can be compensated for at the cars 1.

In use a motor 24 mounted at the base 10 of the one post 6 is connected via a chain 26 to a sprocket 25 carried on the shaft carrying the one arm 3. This force is transmitted via the cars 1 to the other arm 2 for joint and synchronous rotation. The two cars 1 will describe elliptical orbits having a horizontal major axis in the plane P1.

FIG. 3 shows an arrangement wherein identical reference numerals are used for identical structure. In this arrangement the arms 2 and 3 are each provided with a pair of crosspiece halves 15 and 16 extending perpendicular to the respective arm 2 or 3 from the respective axis A thereof. These arms 15 and 16 are bent in as shown in FIG. 5 and each crosspiece half 15 and 16 has at its outer end a pivot 19. The arms 15 are connected together by a link 17 and the arms 16 by a link 18 lying on the plane P1. These links therefore transmit force effectively between the two arms 2 and 3.

It is possible further to rigidify the assembly as shown in FIG. 4 by connecting stiffening struts 20 which may be simply tightened cables between the ends of the arms 15 and 16 and locations 21 and 22 on the arms 2 and 3. These struts 20 therefore rigidify the entire assembly and insure good force transmission from the one arm 2 to the other arm 3. If the arms 15 and 16 lie in the same vertical planes that include the respective arms 2 and 3, it is necessary to provide swivel joints at 19 so that the links 17 and 18 can extend diagonally across the ride.

As shown in FIG. 4 the spacing 23 measured perpendicular to the axis A between the posts 6 and 7 is smaller than twice the radial length of each of the outriggers or arms 15 or 16. These outriggers or arms 15 and 16 in their turn are only half radially as long as the respective arms 2 and 3. Thus the struts 20 are connected each approximately midway between the outer end of each of the arms 2 or 3 and the respective axis A. These struts 20 therefore form a square.

I claim:

1. An orbital amusement ride adapted to stand on the ground and comprising:

a pair of diagonally spaced-apart posts standing on the ground and having respective upper ends defining respective pivot axes, said axes being generally parallel and defining a generally horizontal plane with said posts being generally perpendicular to said plane and spaced apart thereon parallel to said axes;

respective generally parallel arms pivotal on said posts about the respective axes and having respective diametrically opposite first and second arm ends;

drive means for rotating said arms jointly and synchronously about the respective axes with said first ends spaced horizontally from each other and said second ends spaced horizontally from each other; and a first passenger-receiving car pivoted on and bridging said first arm ends and a second passenger-receiving car pivoted on and bridging said second arm ends, whereby on joint synchronous rotation of said arms each of said cars describes a generally elliptical orbit lying in a vertical plane and generally bisected by said horizontal plane.

2. The ride defined in claim 1 wherein each of said cars forms a rigid horizontal link between the respective arm ends.

3. The ride defined in claim 1 wherein each of said arms has a crosspiece extending generally perpendicular to the respective arm and axis and having a respective pair of opposite crosspiece ends, said ride further comprising a pair of links each connected between a respective crosspiece end of one of said crosspieces and a respective crosspiece end of the other crosspiece.

4. The ride defined in claim 3, further comprising struts extending angularly between said crosspiece ends and said arms offset from the respective axes.

5. The ride defined in claim 4 wherein said struts form squares centered on the respective axes.

6. The ride defined in claim 5 wherein said crosspiece ends are equispaced at a predetermined short distance from the respective axes and said arm ends are equispaced at a predetermined long distance equal generally to twice said short distance from the respective axes.

7. The ride defined in claim 1 wherein said drive means includes a motor linked to one of said arms at the respective axis.

8. The ride defined in claim 1 wherein each car has one car end provided with a single pivot bearing connecting it to the respective arm end and another car end provided with a pair of swivel joints connecting it to the respective arm end.

9. The ride defined in claim 1 wherein each of said arms has a crosspiece extending generally perpendicular to the respective arms and axis and having a respective pair of opposite crosspiece ends lying in a vertical plane perpendicular to said axes and equidistant between said posts, said ride including links lying in said vertical plane and extending angularly between said crosspiece ends and said arms.

10. The ride defined in claim 1 wherein said drive means includes a motor at ground level in one of said posts and an endless force-transmission element connected in said one post between said motor and said arm at the respective axis.

11. The ride defined in claim 1 wherein each of said arms has a radial length measured from the respective axis to the respective arm end which is substantially greater than the distance between said posts in a horizontal direction perpendicular to said axes.

* * * * *